US008471472B2

(12) United States Patent
Ishikawa et al.

(10) Patent No.: US 8,471,472 B2
(45) Date of Patent: Jun. 25, 2013

(54) UV ENHANCER FOR DISCHARGE LAMP AND MANUFACTURING METHOD THEREOF

(75) Inventors: Yousuke Ishikawa, Saitama (JP); Nobuo Fukuda, Saitama (JP); Hirokazu Harasawa, Saitama (JP); Kouji Komata, Saitama (JP)

(73) Assignee: Iwasaki Electric Co., Ltd., Tokyo (JP)

( * ) Notice: Subject to any disclaimer, the term of this patent is extended or adjusted under 35 U.S.C. 154(b) by 0 days.

(21) Appl. No.: 13/389,744

(22) PCT Filed: Jun. 22, 2010

(86) PCT No.: PCT/JP2010/060507
§ 371 (c)(1),
(2), (4) Date: Feb. 9, 2012

(87) PCT Pub. No.: WO2011/024547
PCT Pub. Date: Mar. 3, 2011

(65) Prior Publication Data

US 2012/0181924 A1 Jul. 19, 2012

(30) Foreign Application Priority Data

Aug. 28, 2009 (JP) ..... 2009-198300
Aug. 28, 2009 (JP) ..... 2009-198301

(51) Int. Cl.
*H01J 17/44* (2006.01)

(52) U.S. Cl.
USPC ..... 313/594; 445/26

(58) Field of Classification Search
USPC ... 313/25–27, 111–117, 317, 318.01–318.09, 313/483–493, 567–577, 623, 627–643; 439/615, 439/739; 445/22, 24, 26, 29
See application file for complete search history.

(56) References Cited

U.S. PATENT DOCUMENTS 5,990,599 A 11/1999 Jackson et al.
8,154,182 B2 4/2012 Kano et al.

FOREIGN PATENT DOCUMENTS

| | | |
|---|---|---|
| JP | 47-31262 | 8/1972 |
| JP | 2001-512622 | 8/2001 |
| JP | 2002-151006 | 5/2002 |
| JP | 2006-236919 | 9/2006 |
| JP | 2008-140614 | 6/2008 |
| JP | 2009-130211 | 6/2009 |

*Primary Examiner* — Donald Raleigh
(74) *Attorney, Agent, or Firm* — Greenblum & Bernstein, P.L.C.

(57) ABSTRACT

Starting performance is improved by efficient UV-light irradiation, suppressing creeping discharge or atmospheric discharge at the outside of a glow discharge tube, and preventing cracks in a pinch seal portion even when an external force is exerted in the direction of bending a lead. In a discharge tube for emitting a UV-light, a light emitting chamber is formed on one side of a pinch seal portion for sealing an electrode assembly, and a lead protrusion port is formed on the opposite side thereof while pinching the seal portion, the lead protrusion port is formed as a sleeve having a predetermined gap relative to the lead, an external electrode disposed to the outside of the light emitting chamber includes a hold formed by bending fabrication of a metal plate.

4 Claims, 9 Drawing Sheets

100
115
113
110
109R
108
101
116
102
107
104
117
106R
105
106L
107
114
109L
17
22
108
15
110
18
19
21
11
H(13)
24
1
112R 112L
111
108
24
1
17
21
18
23
116
H(13)
12
22
15
19(20)

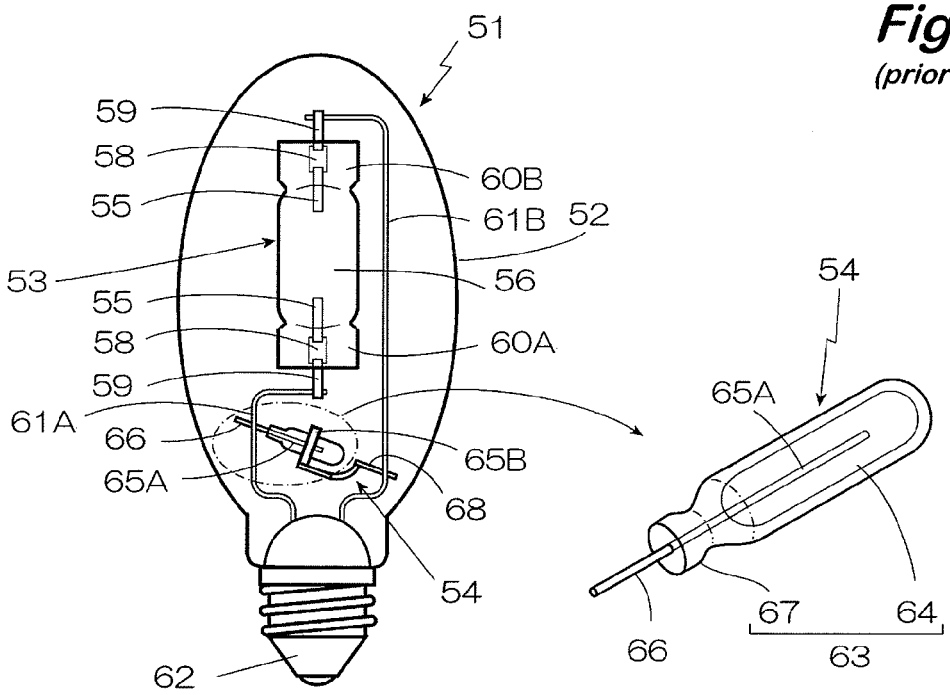
*Fig. 8*
*(prior art)*
*Fig. 9*
*(prior art)*
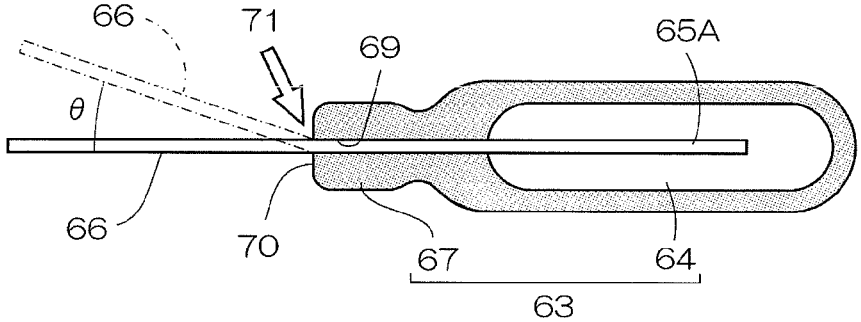

Fig. 10
(prior art)
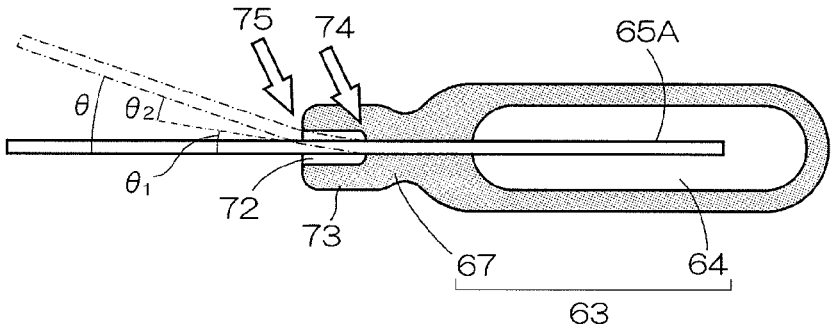
Fig. 11(a)
(prior art)
Fig. 11(b)
(prior art)
Fig. 11(c)
(prior art)
Fig. 11(d)
(prior art)
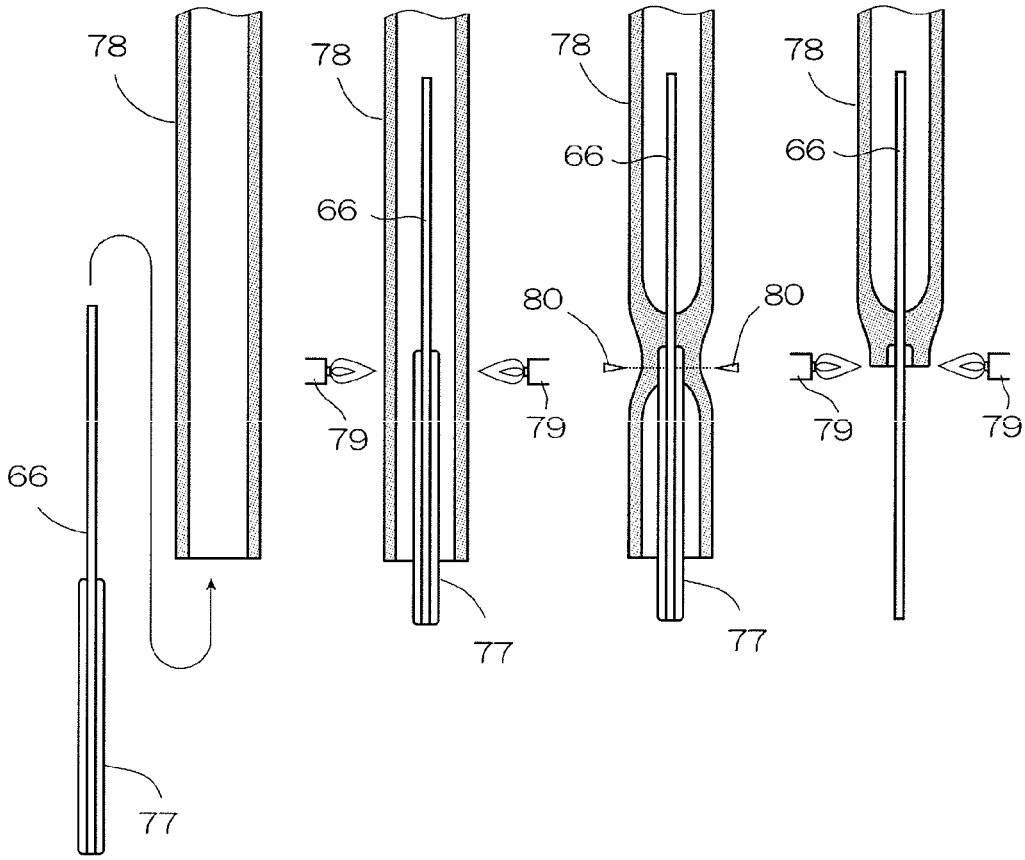

*(prototype)*

*(prototype)*

UV ENHANCER FOR DISCHARGE LAMP AND MANUFACTURING METHOD THEREOF

TECHNICAL FIELD

The present invention concerns a UV enhancer for discharge lamp provided to a discharge lamp including an arc tube in which at least a light-emitting material and a starting gas are filled and a pair of electrodes are opposed to each other in a discharge chamber, the UV enhancer having a discharge tube that irradiates a UV-light to the discharge chamber for enhancing the starting of the lamp, as well as a manufacturing method thereof.

BACKGROUND ART

In light source devices for liquid crystal projectors and DLP projectors which are required to be reduced in size and provide bright projection images, short arc type high pressure mercury vapor discharge lamps which are small in size and can provide light emission at high brightness have been used as the light source. Since the lamps of this type involve a problem that starting performance under cold conditions and restarting performance under hot restrike conditions are not generally preferred, a UV enhancer as a start assisting light source is provided to enhance the starting performance (refer to the Patent Document 1).

A high pressure discharge lamp 51 shown in FIG. 8 has an arc tube 53 and a UV enhancer 54 disposed inside an outer tube 52.

The arc tube 53 has a discharge chamber 56 formed at the central portion thereof in which a pair of tungsten electrodes 55 and 55 are opposed to each other and mercury, halogen such as bromine and a starting gas such as an argon gas are filled therein. A pair of electrode sealed portions 60A and 60B each having the electrode 55, a metal foil 58, and an electrode lead 59 sealed therein are formed from the discharge chamber 56 to both ends of the arc tube 53, and the electrode leads 59 and 59 protruding from the ends of the electrode sealed portions 60A and 60B are connected by way of power feed wires 61A and 61B to a base 62.

The UV enhancer 54 comprises a glow discharge tube 63 that emits UV-light to the discharge chamber 56 for promoting start up of lighting.

The glow discharge tube 63 has a seal portion 67 formed on one end of an airtight chamber that constitutes a light emitting chamber 64 for inserting and sealing an electrode rod 66 that constitutes an internal electrode 65A, and the electrode rod 66 protruding to the outside is welded to the power feed wire 61A on one side.

Further, a ring shaped external electrode 65B fixed by means of cement to the outer peripheral surface of the light emitting chamber 64 is welded by way of a connection wire 68 to the power feed wire 61B on the other side.

According to the constitution, since a starting high frequency pulse voltage supplied by way of the power feed wires 61A and 61B upon lighting of the arc tube 53 is applied between the internal electrode 65A and the external electrode 65B of the UV enhancer 54, glow discharge is caused in the discharge lamp 63 to generate the UV-light which is irradiated to the discharge chamber 54 of the discharge lamp 51 to improve the starting performance.

However, since the UV enhancer 54 of this kind is generally very thin as having a diameter of about 3 mm, when the electrode rod 66 is sealed in the seal portion 67, no sufficient thickness can be ensured the periphery of the electrode rod 66. Then, as shown in FIG. 9, when an external force is exerted in the direction of bending the electrode rod 66 protruding from the seal portion 67, since this is bent only at a corner 71 formed between an inner surface 69 of a through hole for the electrode rod 66 and an end face 70 of the seal portion 67 as a support point, this issued a problem that the bending stress is concentrated to the corner 71, for example, at a bending angle θ of the electrode rod 66 tending to cause cracks therein.

For preventing occurrence of cracks upon bending of the lead of such as the electrode rod protruding from the seal portion of the discharge tube, it has been proposed to form a concave hole 72 to the end face of the seal portion 67 and form a protrusion end 73 of the seal portion 67 into a sleeve-like shape (refer to the Patent document 2).

According to the constitution, as shown in FIG. 10, when an external force is exerted in the direction of bending the electrode rod 66 protruding from the seal portion 67, since the lead is bent at two positions, that is, at a corner 74 formed between the inner surface 69 of the through hole of the electrode rod 66 and a bottom of the concave hole 72 and at a corner 75 at the inner surface of the opening end of the concave hole 72 as support points, for example, the entire bending angle θ of the electrode rod 66 is divided into a bending angle $\theta_1$ at the corner 74 and a bending angle $\theta_2$ at the corner 75 and, accordingly, the bending stress is also dispersed for the respective corners 74 and 75, cracks are less caused.

However, since formation of the concave hole required many steps, it was troublesome and time consuming to result in a problem that not only the manufacturing cost was increased but also the yield was poor.

Previously, as shown in FIG. 11(*a*), a non-fusing agent 77 was coated over the electrode rod 66 so as to have an outer diameter equal with the inner diameter of the concave hole 72, the electrode rod 66 is inserted from one end of a quartz tube 78 and the seal portion 67 is heat-sealed by using a burner 79 as shown in FIG. 11(*b*), the quartz tube 78 was cut to a predetermined length by using a grinding wheel 80 or a file and polishing the non-fusing agent 77 coated over the electrode rod 66 as shown in FIG. 11(*c*).

Then, a glazing treatment of head-melting again the tubular end of the quartz tube 78 by using the burner 79 as shown in FIG. 11(*d*), and amending fine scars or cracks formed by the grinding wheel 80 or the like is performed and then a chipping-off treatment of chipping-off the upper end of the quartz tube 78 to form the light emitting chamber 64 was performed.

As described above not only the non-fusing agent 77 has to be coated over the electrode rod 66 but also the coated the non-fusing agent 77 has to be removed by polishing after cutting off the quartz tube 78, as well as twice heat treatment is necessary, including a heat treatment of softening the quartz tube 78 for sealing the electrode rod 66 and a glazing treatment of heating the tubular end after cutting the quartz tube 78 are necessary.

Further, since the UV-light power of the UV enhancer depends on an electric field formed between the external electrode and the internal electrode, the UV-light can be outputted more efficiently as the area of the external electrode is larger when the potential difference between both of the electrodes is equal.

However, in a case of using the ring-shaped external electrode 65B as shown in FIG. 8, when the width of the ring is made large for increasing the UV-light output, since the light emitting chamber 64 of the glow discharge tube 63 is covered by the external electrode 65B, this gives a problem that the UV-light is shielded and the UV-light cannot be irradiated by a necessary and sufficient amount to the discharge chamber 56 of the lamp 51.

Accordingly, the present applicant trially manufactured the UV enhancer capable of efficiently irradiating a UV-light by a necessary and sufficient amount into the discharge chamber of the high pressure discharge lamp without shielding the UV-light even when the area of the external electrode is increased (Japanese Application No. 2009-130211).

FIGS. 12(*a*) and (*b*) show such a UV enhancer 81. A flat pinch seal portion 84 is formed on one end of a glow discharge tube 83 in which an airtight chamber that constitutes a light emitting chamber 82 is formed on the other end, and an electrode assembly 85 comprising an internal electrode 85*b* and an electrode lead 85*c* welded on both sides of a sealing metal foil 85*a* is sealed in the pinch seal portion 84.

An external electrode 86 disposed to the outside of the light emitting chamber 82 comprises a holder 87 formed by bending fabrication of a metal plate so as to grip the light emitting chamber 82, and a slit 88 for irradiating the UV-light to the discharge chamber and a clip 89 for holding the pinch seal portion 84 by gripping both the surface and the rearface thereof are formed to the holder 87.

According to the UV enhancer 81, as shown in FIG. 12(*b*), since the external electrode 86 that functions as the holder 87 covers the outer peripheral surface of the light emitting chamber 82 so as to grip the chamber, the area of the external electrode 86 can be ensured sufficiently and the UV-light can be irradiated efficiently.

Further, since the slit 87 is formed, when the slit 87 is disposed being directed to the discharge chamber of the high pressure discharge lamp, the UV-light is not shielded by the external electrode 86.

However, since the pinch seal portion 84 is formed flat, when the glow discharge tube 83 having the external electrode 86 attached thereto is mounted to the discharge lamp, if the external electrode 86 as the holder 87 is positionally displaced and the clip 89 approaches extremely to the lead 85*c* of the electrode assembly 85, insulation distance cannot be ensured between the electrode lead 85*c* and the external electrode 86 applied with a voltage at opposite polarity, which may possibly cause creeping discharge or atmospheric discharge at the outside of the glow discharge tube 83.

Further, since the electrode assembly 85 is sealed by a flat pinch seal portion 84, no sufficient strength can be ensured in the direction of the thickness and cracks tend to be caused in the pinch seal portion 84 when the electrode lead 85*c* is bent in the direction of the thickness. In addition, when it is intended to form a concave hole in the end face of the pinch seal portion 84 by the method described in the Patent Document 2, there occurs another problem that such concave hole cannot be formed since there is no sufficient margin in the direction of the thickness of the pinch seal portion 84.

PRIOR ART DOCUMENT

Patent Document

[Patent Document 1] JP-T 2001-512622
[Patent Document 2] JP-B Sho 47-31262

SUMMARY OF THE INVENTION

Subject to be Solved by the Invention

In view of the above, it is a technical subject of the present invention to improve the starting performance by efficient irradiation of a UV-light by a necessary and sufficient amount into a discharge chamber of a high pressure discharge lamp and, at the same time, suppressing creeping discharge or atmospheric discharge between an internal electrode and an external electrode at the outside of a glow discharge tube and, further, preventing cracks from being formed in the pinch seal portion even when an external force is exerted in the direction of bending the electrode lead protruding from the pinch seal portion.

Means for Solving the Subject

For solving the subject described above, the UV enhancer for a discharge lamp according to the present invention has a discharge tube provided to the discharge lamp including an arc tube in which at least a light-emitting material and a starting gas are filled and a pair of electrodes are opposed to each other in a discharge chamber, the UV enhancer having a discharge tube that irradiates a UV-light to the discharge chamber for enhancing the starting of the lamp, wherein the discharge tube has a light-emitting chamber formed on one side of a pinch seal portion for sealing an electrode assembly comprising an internal electrode and a lead welded to both ends of a sealing metal foil, and a lead protrusion port formed on the other side of the pinch seal portion for protruding the lead, the lead protrusion port comprises a sleeve having a predetermined gap relative to the lead and extended along an axial line of the lead, a holder that constitutes an external electrode formed by bending fabrication of a metal plate so as to grip the light-emitting chamber is attached to the light emitting chamber and the holder has a slit for irradiating the UV-light therethrough to the discharge chamber and a clip for holding the pinch seal portion while gripping both the surface and the rearface, and a ridge is formed at the surface of the pinch seal portion for positioning the clip at a predetermined insulation length away from the end of the lead protrusion port of the discharge tube.

Further, a manufacturing method of a UV enhancer for discharge lamp provided to the discharge lamp including an arc tube in which at least a light-emitting material and a starting gas are filled and a pair of electrodes are opposed to each other in a discharge chamber, the UV enhancer having a discharge tube that irradiates a UV-light to the discharge chamber for enhancing the starting of the lamp includes:

defining, in a quartz tube that constitutes the discharge tube, a light-emitting area having the internal electrode disposed therein on one side of a pinch seal area for sealing a sealing metal foil of an electrode assembly comprising an internal electrode and a lead welded to both ends of the metal sealing foil, and a lead protrusion area on the other side of the pinch seal area for protruding the lead, and includes:

a heating step of simultaneously performing a heat-softening treatment for the pinch seal area and a glazing treatment for a tubular end of the lead protrusion area, in a state of inserting the electrode assembly from the lead protrusion area and protruding the lead from the lead protrusion area, a pinch sealing step of putting the pinch seal area heated during the heating step on both sides between the molds, thereby simultaneously forming a lead protrusion port while having the lead protrusion area remaining in a sleeve-like shape and a pinch seal portion sealing the pinch seal area, and molding a ridge to a position on the surface of the pinch seal portion for positioning an external electrode at a predetermined insulation length away from the tubular end of the lead protrusion area, and a chip-off step of chipping-off the top end of the light-emitting area by burner-heating after the completion of the pinch sealing step.

Effect of the Invention

According to the present invention, since the external electrode of the UV enhancer comprises the holder formed by bending fabrication of the metal plate so as to grip the light emitting chamber, the external electrode can be attached to the discharge tube by merely attaching the discharge tube to the holder.

Then, upon starting lighting of the high pressure discharge lamp, when a starting voltage supplied from a starting circuit is applied between the external electrode and the internal electrode, the UV-light is irradiated from the discharge tube. Since the discharge tube is held by the holder having the slit for the UV-light irradiation, when it is mounted with the slit 11 being directed to the discharge chamber of the high pressure discharge lamp, the UV-light irradiated from the discharge tube is reliably irradiated through the slit to the discharge chamber of the high pressure discharge lamp.

In the discharge tube, the light emitting chamber is formed on one side of the pinch seal portion and the lead protrusion port for protruding the lead is formed on the opposite side thereof while pinching the pinch seal portion, and the lead protrusion port is formed into the sleeve-like shape with no pinch sealing.

In the sleeve, since a predetermined gap is formed between the sleeve and the lead, when an external force exerted in the direction of bending the lead, since the lead is bent at two points, i.e., at the bottom of the sleeve and at the opening end of the sleeve as support points, the bending stress is dispersed and the cracks are less caused.

Further, at the surface of the pinch seal portion, since the ridge is formed at a position spaced apart by a predetermined insulation length away from the end of the discharge tube on the side of the lead protrusion port, when the clip of the external electrode is held on the side of the light emitting chamber of the ridge so as to grip both on the surface and the rearface of the pinch seal portion, the insulation state between the lead and the external electrode is maintained without causing positional displacement of the external electrode, creeping discharge or atmospheric discharge is not generated at the outside of the glow discharge tube.

BRIEF EXPLANATION OF THE DRAWINGS

FIG. 8 is an explanatory view showing an high pressure discharge lamp using an existent UV enhancer.

FIG. 9 is a cross sectional view of the existent UV enhancer.

FIG. 10 is a cross sectional view of an improved UV enhancer.

FIG. 11 is an explanatory view showing manufacturing steps thereof.

EMBODIMENT FOR CARRYING OUT THE INVENTION

For attaining the purpose to improve the starting performance by efficiently irradiating UV-light by a necessary and sufficiently amount into a discharge chamber of a high pressure discharge lamp, suppressing creeping discharge or atmospheric discharge between an internal electrode and an external electrode at the outside of a glow discharge tube, further, not causing cracks in the pinch seal portion even when an external force is exerted in the direction of bending an electrode lead protruding from the pinch seal portion, the UV enhancer according to the present invention has a discharge tube that irradiates the UV-light in which the discharge tube has a light-emitting chamber having the internal electrode formed on one side of the pinch seal portion sealing an electrode assembly comprising the internal electrode and a lead welded to both ends of a sealing metal foil, and a lead protrusion port formed on the other side of the pinch seal portion for protruding the lead, a lead protrusion port comprises a sleeve having a predetermined gap relative to the lead, extended along an axial line of the lead, a holder that constitutes the external electrode formed by bending fabrication of a metal plate so as to grip the light-emitting chamber is attached to the light emitting chamber and the holder has a slit for irradiating the UV-light therethrough to the discharge chamber and a clip for holding the pinch seal portion on both the surface and the rearface, and a ridge is formed at the surface of the pinch seal portion for positioning the clip at a predetermined insulation length away from the tubular end at the lead protrusion port of the discharge tube.

Embodiment 1

Figure 2:
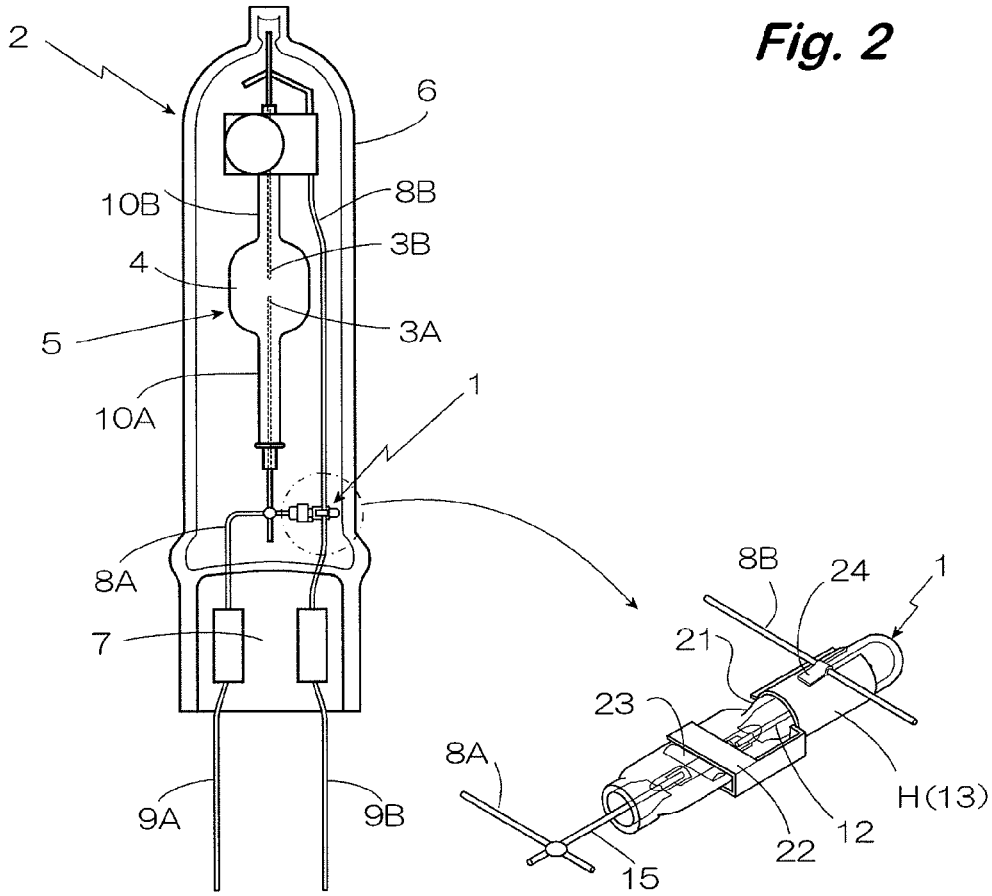
FIG. 2 is an entire view showing a high pressure discharge lamp using the UV enhancer.

FIG. 2 shows a high pressure discharge lamp 2 provided with a UV enhancer 1 and having an arc tube 5 in which at least a light-emitting material and a starting gas are filled in a discharge chamber 4 where a pair of electrodes 3A and 3B are opposed to each other.

As the high pressure discharge lamp 2, a ceramic metal halide lamp containing the heat resistant arc tube 5 made of ceramics in an airtight tube 6 made of glass is used, and the UV enhancer 1 that constitutes a starting light source is disposed inside a seal tube 6.

One end of the seal tube 6 is hot pressed to form a pinch seal portion 7, a pair of power feed leads 9A and 9B connected to the electrode leads 8A and 8B protruding from both ends of the arc tube 5 are protruding from the pinch seal portion 7 to the outside of the seal tube 6, and connected to a lighting circuit (not illustrated).

In the ceramic arc tube 5, at least the light-emitting material and a starting gas are filled in the discharge chamber 4, and a portion from the discharge chamber 4 to both ends of the arc tube 5 are airtightly sealed to form a pair of electrode sealed portions 10A and 10B sealing the electrodes 3A and 3B therein respectively.

Figure 1A:
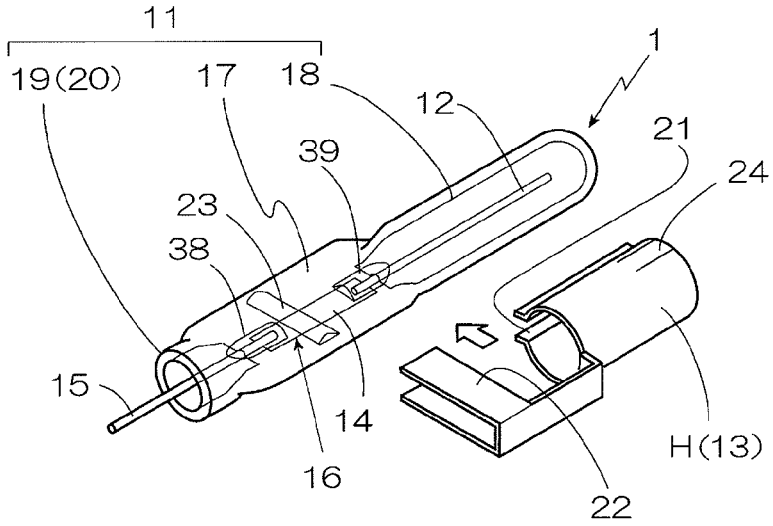
FIG. 1 is an explanatory view showing an example of a UV enhancer according to the present invention.
Figure 1B:
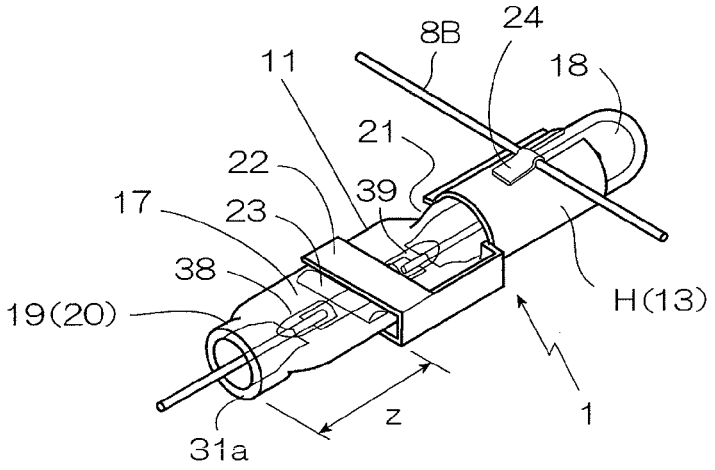

As shown in FIG. 1 and FIG. 2, the UV enhancer 1 has a discharge tube 11 that emits a UV-light for enhancing the starting performance to the discharge chamber 4 of the high pressure discharge lamp 2, and the UV-light is generated by the application of a starting voltage between an inner electrode 12 and an outer electrode 13 of the discharge tube 11 upon starting lighting of the high pressure discharge lamp 2.

In the discharge tube 11, as shown in FIG. 1(*a*), a light emitting chamber 18 having the inner electrode 12 disposed therein is formed on one side and a lead protrusion port 19 for leading out a lead 15 is formed on the opposite side of a pinch seal portion 17 for sealing an electrode assembly 16 comprising the internal electrode 12 and the lead 15 welded to both ends of a sealing metal foil 14 such as a molybdenum foil.

The light emitting chamber 18 is formed airtightly and a rare gas such as an argon gas is filled therein.

In the lead protrusion port 19, a sleeve 20 having a predetermined gap relative to the lead 15 led out from the pinch seal portion 17 is formed being extended in the axial direction of the lead 15.

A holder H that constitutes the external electrode 13 formed by bending fabrication of a sheet of metal plate such as made of spring stainless steel (SUS304-CSP) of 0.2 mm thickness is attached so as to grip the light emitting chamber 18.

In this embodiment, the metal plate is bent so as to cover the outer peripheral surface of the light emitting chamber 18 of the discharge tube 11, and formed into a C-shaped cross sectional shape that the abutting top end portions are away from each other to form a slit 21 for exposing the portion of the outer peripheral surface of the light emitting chamber 18, and the metal plate is formed to such a shape as covering the light emitting chamber 18 excluding a portion exposed through the slit 21.

Thus, when the enhancer is mounted with the slit 21 being directed to the discharge chamber 4, the UV-light irradiated from the light emitting chamber 18 is irradiated to the discharge chamber 4.

Further, a grip 22 is formed to the holder H for holding the external electrode 13 while gripping the pinch seal portion 17 both on the surface and the rearface, and a ridge 23 is formed to the surface of the pinch seal portion 17 for positioning the grip 22 to a position spaced apart by a predetermined insulation length away from the end 19 of the discharge tube 11 on the side of the leading out portion.

The inner surface of the holder H for the portion covering the outer peripheral surface of the light emitting chamber 18 is formed as a UV-light reflection surface, so that the irradiation amount of the UV-light can be increased substantially by reflecting the UV-light irradiated from the discharge tube 11 as much as possible toward the slit 21.

Further, a press fitting tab terminal 24 is formed in the holder H for fixing and electrically connecting the external electrode 13 to a conductor part (electrode lead 8B) applied with a voltage at a polarity opposite to that of the internal electrode 12.

Then, as illustrated in FIG. 1(*b*), when the holder H that constitutes the external electrode 13 is attached to the discharge tube 11, and the terminal 24 thereof is bent so as to grip an electrode lead 8B and spot welded to the electrode lead 8B, the discharge tube 11 is firmly fixed to the electrode lead 8B comprising a molybdenum wire having rigidity and, at the same time, the external electrode 13 is connected electrically to the electrode 3B on one side of the high pressure discharge lamp 2.

Further, when the lead 15 of the internal electrode 12 is spot-welded to an electrode lead 8A, the internal electrode 13 is electrically connected to the electrode 3B on one side of the high pressure discharge lamp 2.

Then, steps of manufacturing the UV enhancer 1 is to be described with reference to FIG. 3.

Figures 3A, 3B, 3C, 3D:
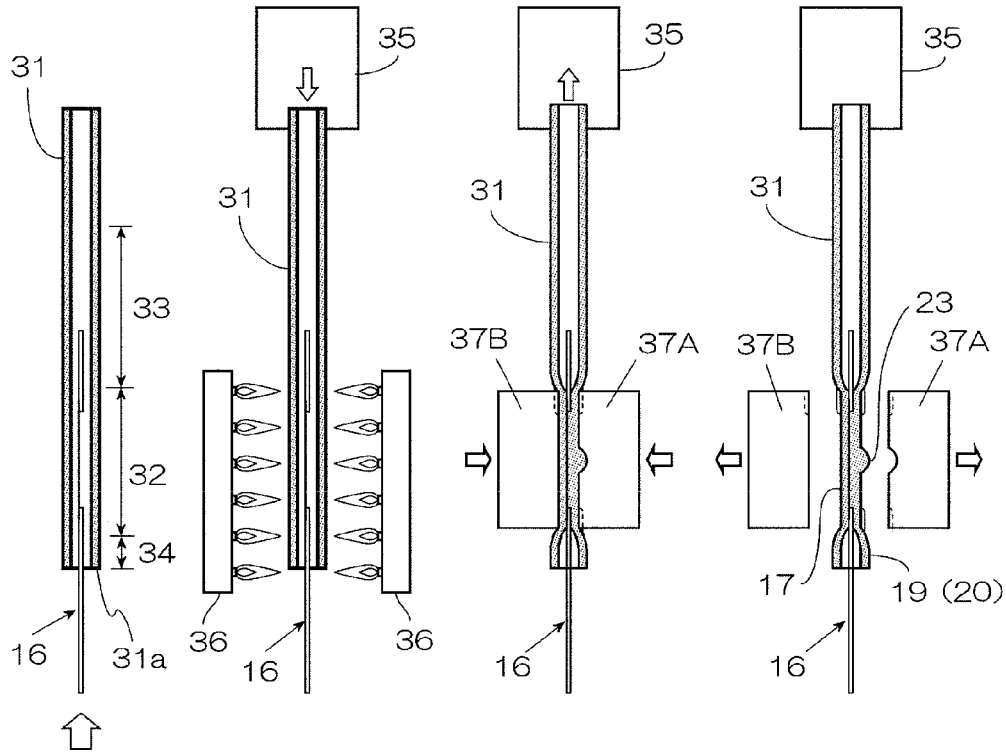
FIG. 3 is an explanatory view showing manufacturing steps of the UV enhancer.

At first, as shown in FIG. 3(*a*), an electrode assembly 16 comprising the internal electrode 12 and the lead 15 welded to both ends of the sealing metal foil 14 such as a molybdenum foil is provided, and a quartz tube 31 that constitutes the discharge tube 11 is cut into a predetermined length.

In the quartz tube 31, a lead protrusion area 34, a pinch seal area 32, and a light emitting area 33 are defined from a tubular end 31*a*, thereof corresponding to the portions that define the lead protrusion port 19, the pinch seal portion 17, and the light emitting chamber 18 of the discharge tube 11 are defined, and the electrode assembly 16 is inserted on the side of the lead protrusion area 34.

Then, as shown in FIG. 3(*b*), in a state of fixing the upper end of the quartz tube 31 to a gas filling/exhaust device 35, positioning the electrode assembly 16, and leading out the lead 15, a heating step of simultaneously performing a heat softening treatment for the pinch seal area 32 by a burner 36 and a glazing treatment of eliminating fine scars at the tubular end 31*a* formed upon cutting the quartz tube 31 to smooth the face while blowing an inert gas such as an argon gas into the quartz tube 31 is conducted.

Then, as shown in FIG. 3(*c*), a pinch seal step of forming the pinch seal portion 17 is performed by putting the pinch seal area 32 between the molds 37A and 37B so as to pinch the metal foil 14 of the electrode assembly 16 on both the surface and the rearface thereof.

Figure 5:
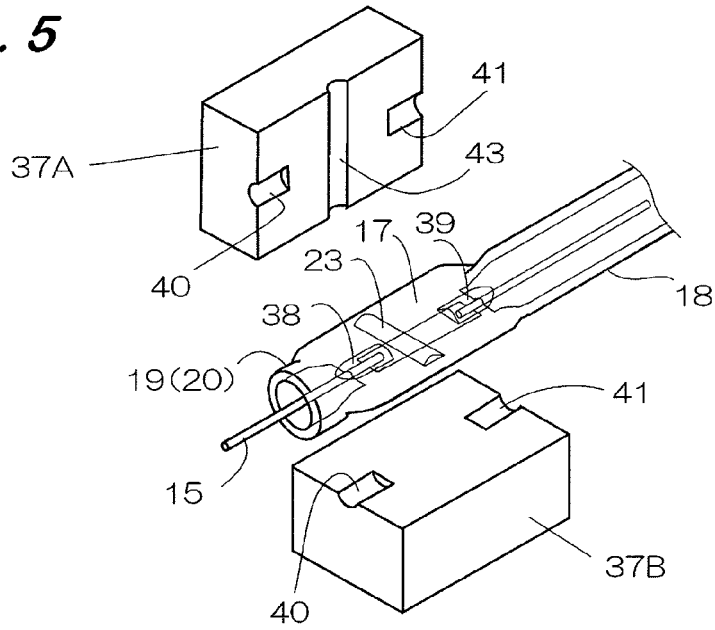
FIG. 5 is an explanatory view showing a mold used in a pinch seal step.

As shown in FIG. 5, the concaves 40 and 41 are formed in the molds 37A and 37B for forming the thickened portions 38 and 39 to a portion corresponding to the internal electrode 12 and the lead 15 of the electrode assembly 16 sealed in the pinch seal portion 17 and, further, a concave groove 43 is formed to the mold 37A on one side for forming a ridge 23 to the surface of the pinch seal portion 17 spaced apart by a predetermined insulation length z from the tubular end 31*a* of the lead drawing out area 34.

Since the length for the molds 37A and 37B is made equal with the length for the pinch seal area 32, when the pinch seal area 32 is pinched between the molds 37A and 37B, only the pinch area 32 is pressed to form the pinch seal portion 17, while the lead protrusion area 34 and the light emitting area 33 are not pressed but maintained at a size for the diameter of the quartz tube 31.

Then, when molds are released as shown in FIG. 3(*d*) upon lowering of the temperature to a predetermined level, the pinch seal portion 17 is formed and, at the same time, the thickened portions 38 and 39 and the ridge 23 for positioning the clipping of the external electrode 13 are formed to corresponding portions of the internal electrode 12 and the lead 15 at the surface thereof.

Figure 4A:
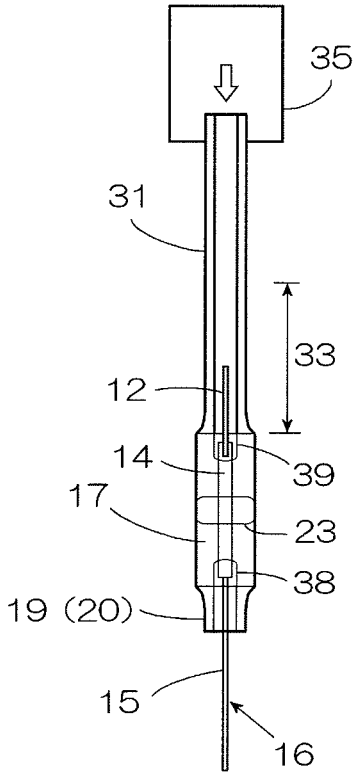
FIG. 4 is an explanatory view showing manufacturing steps of the UV enhancer.
Figure 4B:
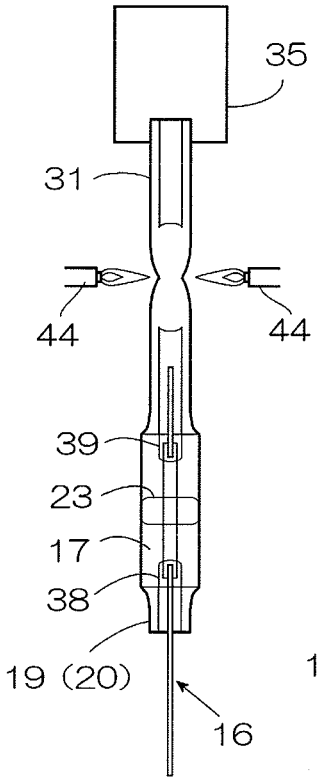
Figure 4C:
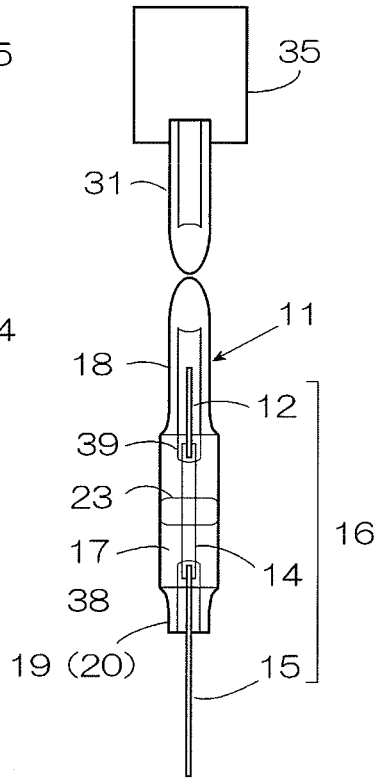

FIG. 4(*a*) is a view showing the state in which the pinch seal portion 17 of the quartz tube 31 after finishing the pinch seal step is directed to the front. Then a chip-off step of chipping-off the light emitting area 33 is performed (FIG. 4(*b*), (*c*)).

In the chipping-off step, after at first evacuating the inside of the light emitting area 33 by the gas filling/exhaust device 35, an argon gas is filled at a predetermined pressure, for example, of 50 Torr.

Then, as shown in FIGS. 4(*b*) to (*c*), the top end the light emitting area 33 is heated by a burner 44, and the light emitting area 33 is cut off with no intrusion of atmospheric air in the quartz tube 31 to form the discharge tube 11.

Finally, as shown in FIG. 1(*b*), when the clip 22 of the holder H that constitutes the external electrode 13 is attached to the light emitting chamber 18 along the ridge 23 of the pinch seal portion 17, the UV enhancer 1 is completed. Since the external electrode 13 is positioned by the ridge 23, an appropriate insulation length can be ensured between the external electrode 13 and the lead 15.

As described above, according to this embodiment, since softening of the pinch seal area 32 and the glazing treatment for the tubular end 31*a* of the quartz tube 31 are performed simultaneously in the heating step prior to the pinch sealing step, the heating step may suffice only for once.

Further, since the pinch seal portion 17 and the lead protrusion port 19 are formed and the thickened portions 38 and 39 and the positioning ridge 23 are formed on the surface of the pinch seal portion 17 by one step of pressing the pinch seal area 32 of the heated quartz tube 11 by the molds 37A and 37B for sealing the electrode assembly 16 of the discharge tube 11 of the UV enhancer 1, the number of manufacturing steps can be decreased extremely and the manufacturing cost is not increased so much.

For the thus manufactured UV enhancer 1, when the holder H is fixed to the electrode lead 8B with the slit 21 of the holder H being upwarded and the lead 15 of the internal electrode 12 of the discharge tube 11 is connected to the electrode lead 8A of the high pressure discharge lamp 2 by welding or the like, the operation of mounting the discharge tube 11 as the starting light source is completed.

In this process, since the holder H can be secured provisionally to the electrode lead 8B by bending the tab terminal 24, positioning can be facilitated. Further, since the holder is connected electrically by way of the tab terminal 24, troublesome wiring operation can also be simplified.

Further, since an appropriate insulation length can be ensured between the external electrode 13 and the lead 15 by positioning the external electrode 13 along the ridge 23, creeping discharge or atmospheric discharge is less caused upon lighting.

Figure 6:
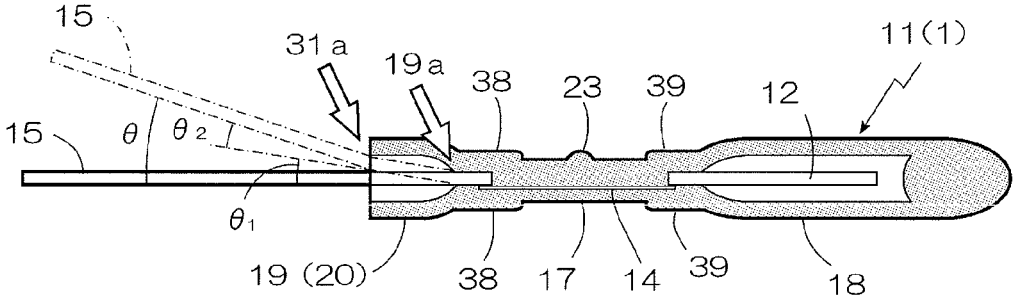
FIG. 6 is a cross sectional view of the discharge tube of the UV enhancer.

Even when an external force is exerted to bend the lead 15 during attaching operation, since the lead is bent at two positions as shown in FIG. 6, at a bottom 19*a* of the lead protrusion port 19 and at the tubular end 31*a* as the support points, the entire bending angle θ of the lead 15 is divided, for example, to the bending angle $\theta_1$ at the bottom 19*a* of the lead protrusion port 19 and the bending angle $\theta_2$ at the tubular end 31*a* and the bending stress is also dispersed, cracks are less caused.

Then when the high pressure discharge lamp 2 is started for lighting, a starting voltage is applied between the internal electrode 12 and the external electrode 13 of the discharge tube 11 from the lighting circuit (not illustrated) thereof, discharge that excites a rare gas is caused in the rare gas filled in the light emitting chamber 18 to generate a UV-light, and the UV-light is irradiated through the slit 21 of the holder H that constitutes the external electrode 20 to the outside and irradiated to the discharge chamber 4 of the arc tube 5. Then, the starting gas filled in the discharge chamber 4 is excited, and tungsten forming the electrodes 3A and 3B emits initial electrons necessary for starting discharge to promote starting of the high pressure discharge lamp 2.

In this case, since the external electrode 13 of the discharge tube 11 comprises the holder H formed of the metal plate bending into a shape for gripping and holding the outer peripheral surface of the light emitting chamber 18, the electrode area is outstandingly large compared with that of the ring-shaped electrode and a UV-light can be generated by a necessary and sufficient amount to enhance the starting performance of the lamp.

Further, since the slit 21 is formed in the holder H, and the inner surface of the holder H is formed as a UV-light reflection surface, the UV-light generated in the discharge tube 11 can be emitted with no loss through the slit 21 and irradiated to the discharge chamber 4.

Embodiment 2

Figure 7:
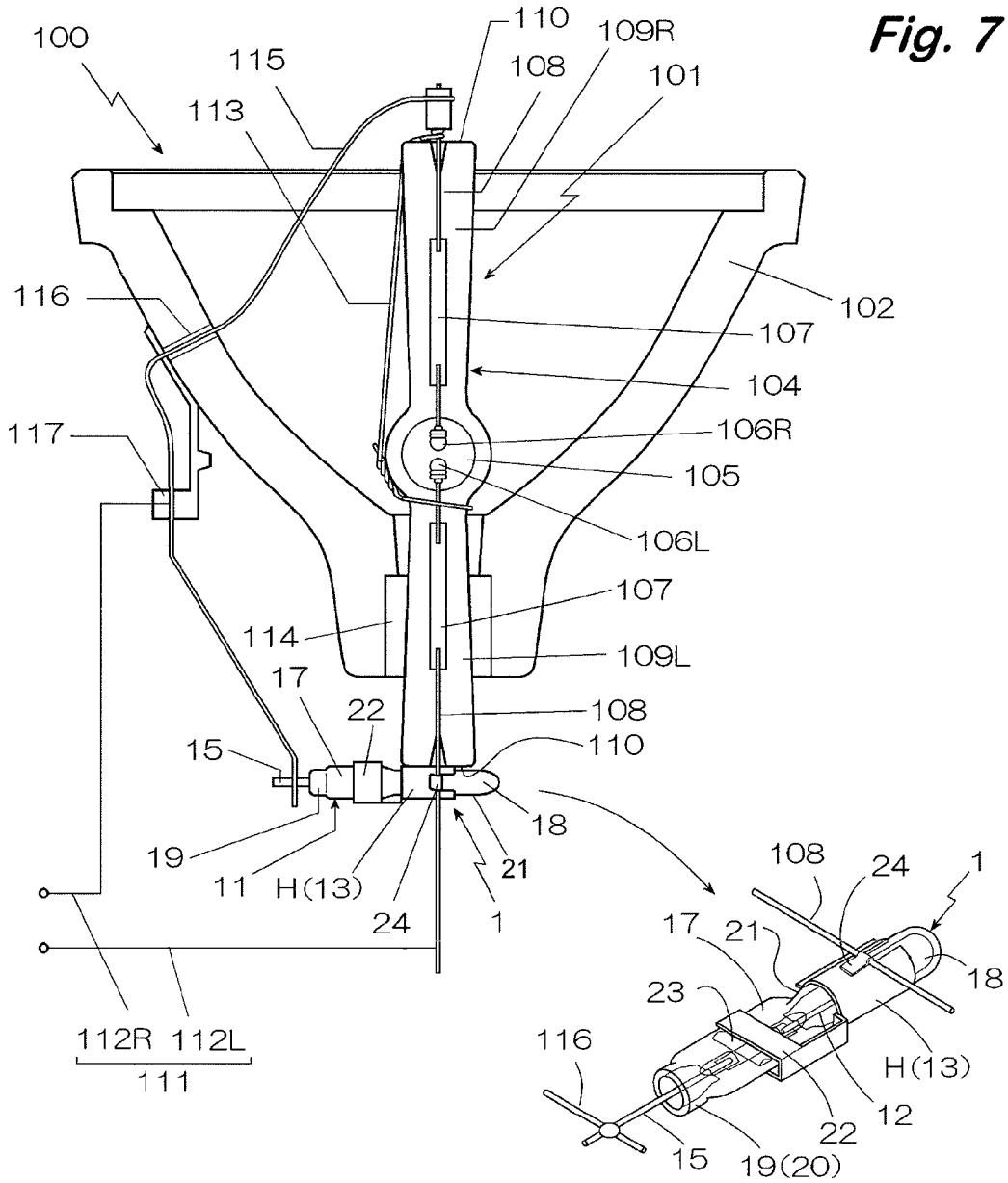
FIG. 7 is an explanatory view showing another embodiment of use.
Figure 12A:
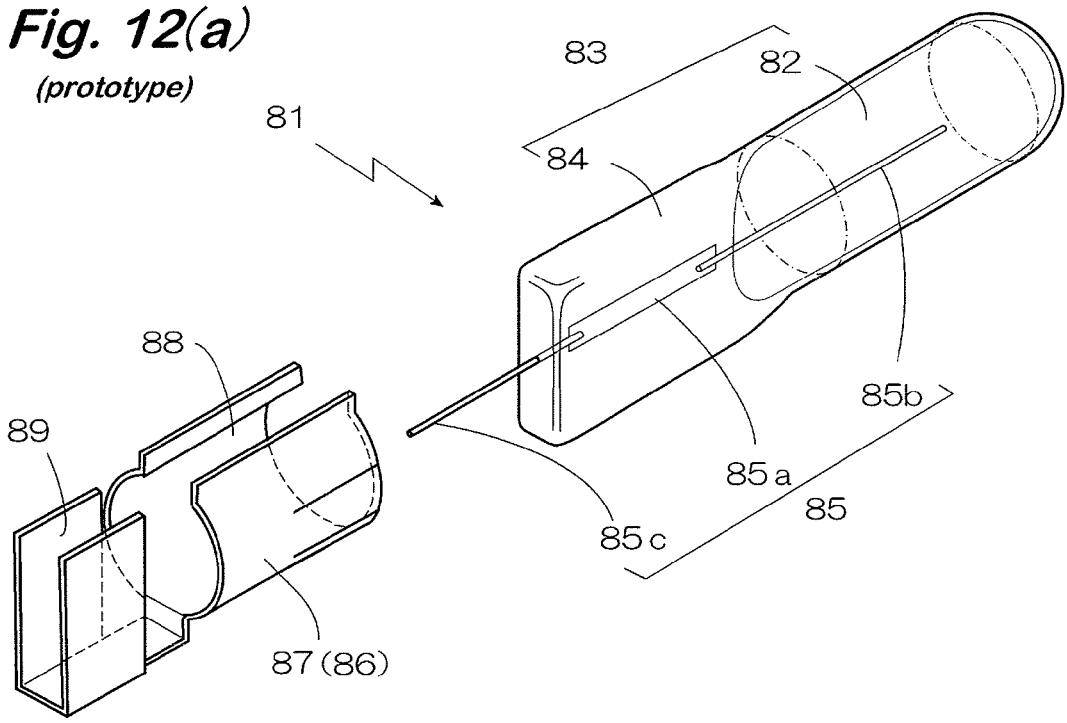
FIG. 12 is an explanatory view showing an UV enhancer trially manufactured by the present application.
Figure 12B:
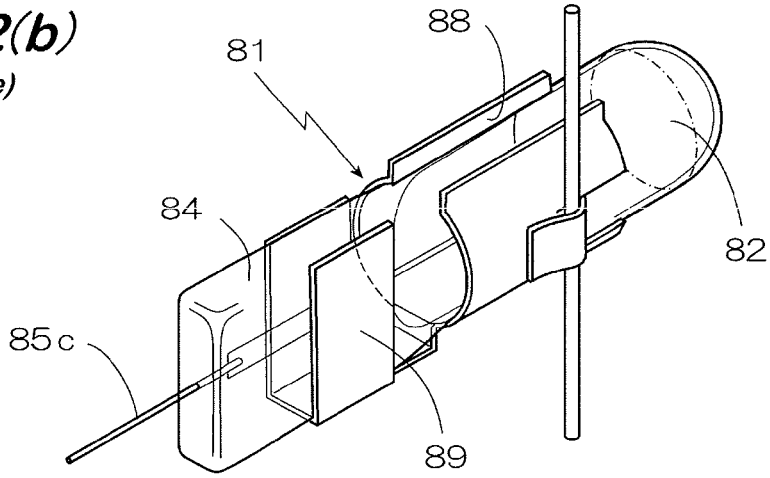

FIG. 7 shows an embodiment of using a UV enhancer 1 mounted to a discharge lamp 101 of a light source device 100 of a projector, in which portions in common with those of FIG. 1 carry the same reference numerals for which detailed descriptions are to be omitted.

The light source device 100 has a high pressure discharge lamp 101 and a concave reflector 102 for reflecting a light emitted from the lamp 101.

In the high pressure discharge lamp 101, a pair of tungsten electrodes 106R and 106L are opposed to each other at a short inter-electrode distance of about 1 mm in a discharge chamber 105 of an arc tube 104 comprising quartz glass, mercury, halogen such as bromine, and a starting gas such as an argon gas are filled therein, and a pair of electrode sealed portions 109R and 109L are formed by airtightly sealing a portion from the discharge chamber 105 to both ends of the arc tube 104 and sealing each of the electrodes 106R and 106L, a metal foil 107 comprising a molybdenum foil connected therewith, and an electrode lead 108 comprising a molybdenum wire.

Then, the electrode leads 108 and 108 protruding from the ends 10 of the respective electrode sealed portions 109R and 109L are connected to one polar side 112R and the other polar side 112L of a lighting circuit 111 for supplying a lamp power respectively, and a metal wire 113 as a trigger wire/antenna wire for promoting arc discharge between the electrodes 106R and 106L is wired such that the wire is connected at one end to the electrode lead 108 protruding from a end face 110 of the electrode sealed portion 109R and is wound at the other end in a loop shape around the outer periphery of the electrode sealed portion 109L.

The concave mirror 102 has a bottom hole 114 opened at the bottom for inserting the electrode sealed portion 109L on one side of the high pressure discharge lamp 101 and fixing the portion with cement or the like and has a wiring hole 116 perforated through reflection portion thereof for inserting a lead 115 comprising a nickel wire connected with the lead electrode 108 protruding from the electrode sealed portion 109R on the other side of the high pressure discharge lamp 101, and has a wiring metal 117 secured at the back of the reflection portion for fixing the lead 115 led out through the wiring hole 116.

The UV enhancer 1 is connected in parallel with the high pressure discharge lamp 101 to a lighting circuit 111 that applies a starting voltage between the electrodes 106R and 106L upon starting lighting so that the starting voltage is applied between the internal electrode 12 and the external electrode 13 of the discharge tube 11.

Then, when the holder H is fixed to the electrode lead 108 with the slit 22 of the holder H being upwarded so as to oppose the end face 110 of the electrode sealed portion 109L of the high pressure discharge lamp 101 and the discharge tube 11 is inserted therein, the external electrode 13 is mounted to the light emitting chamber 18.

Then, when the lead 15 of the internal electrode 12 of the discharge tube 11 is connected to one side (on the side of the electrode 106R) 112R of the lighting circuit 111 by welding or the like, the operation of mounting the UV enhancer is completed.

Then, when the high pressure discharge lamp 101 is started for lighting, a starting voltage is applied between the internal electrode 12 and the external electrode 13 of the UV enhancer 1 from the lighting circuit 111, and the internal electrode 12 and the external electrode 13 are rendered to opposite polarities to form an electric field between them.

Then, dielectric breakdown is caused between the internal electrode 12 and the external electrode 13, in which discharge that excited the rare gas sealed in the light emitting chamber 18 is caused to generate a UV-light, the UV-light is emitted through the slit 22 of the holder H that constitutes the external electrode 13 and entered to the end face 110 of the electrode sealed portion 109L of the lamp 101, and irradiated into the discharge chamber 105 by transmission and propagation through the inside of the electrode sealed portion 109L. Then, the starting gas filled in the discharge chamber 105 is excited, and tungsten that forms the electrodes 106R and 106L emits initial electrons necessary for starting discharge to promote starting of the high pressure discharge lamp 101.

Also in this case, since the UV enhancer 1 is completed by attaching the clip 22 of the holder H that constitutes the external electrode 13 on the side of the light emitting chamber 18 along the ridge 23 on the pinch seal portion 17 and the external electrode 13 is positioned along the ridge 23, an appropriate insulation length can be ensured between the external electrode 13 and the lead 15 and, as a result, the creeping discharge or atmospheric discharge is less caused upon lighting.

INDUSTRIAL APPLICABILITY

The present invention contributes to the improvement of the starting performance of a high pressure discharge lamp used for a light source device such as a liquid crystal projector, DLP projector, or illumination apparatus.

DESCRIPTION FOR REFERENCES

1 UV enhancer
2 high pressure discharge lamp
3A, 3B electrode
4 discharge chamber
11 discharge tube
12 internal electrode
13 external electrode
14 sealing metal foil
15 lead
16 electrode assembly
17 pinch seal portion
18 light emitting chamber
19 lead protrusion port
20 sleeve
H holder
21 slit
22 clip
23 ridge
31 quartz tube
31*a* tubular end
32 pinch seal area
33 light emitting area
34 lead protrusion area
35 gas filling/exhaust device
36 burner
37A, 37B mold
38, 39 thickened portion
Z insulation length

The invention claimed is:

1. A UV enhancer for a discharge lamp provided to the discharge lamp including an arc tube in which at least a light-emitting material and a starting gas are disposed and a pair of electrodes opposed to each other in a discharge champer therein, the UV enhancer having a discharge tube that irradiates a UV-light to the discharge chamber for enhancing a starting of the lamp, wherein the discharge tube has a light-emitting chamber provided on one side of a pinch seal portion for sealing an electrode assembly comprising an internal electrode and a lead welded to ends of a sealing metal foil, and a lead protrusion port provided on a second side of the pinch seal portion for protruding the lead, the lead protrusion port comprises a sleeve having a predetermined gap relative to the lead and extends along an axial line of the lead, a holder that constitutes an external electrode is configured as a metal plate that grips the light-emitting chamber is attached to the light emitting chamber and the holder has a slit for irradiating the UV-light therethrough to the discharge chamber and a clip for holding the pinch seal portion while gripping both a front surface and a rear surface of the pinch seal portion, and a ridge is provided at the front surface of the pinch seal portion for positioning the clip at a predetermined insulation length away from a tubular end of the lead protrusion port of the discharge tube.

2. The UV enhancer for the discharge lamp according to claim 1, wherein a thickened portion is formed partially on the front surface of the pinch seal portion at a position corresponding the internal electrode and the lead of the electrode assembly sealed in the pinch seal portion.

3. A method of manufacturing a UV enhancer for a discharge lamp provided to discharge lamp including an arc tube in which at least a light-emitting material and a starting gas are filled and a pair of electrodes are opposed to each other in a discharge chamber therein, the UV enhancer having a discharge tube that irradiates a UV-light to the discharge chamber for enhancing a starting of the lamp the method including:

defining, in a quartz tube that constitutes the discharge tube, a light-emitting area having an internal electrode disposed therein on one side of a pinch seal area for sealing a metal foil of an electrode assembly comprising the internal electrode and a lead welded to ends of the metal foil, and a lead protrusion area formed on a second side of the pinch seal area for protruding the lead:

simultaneously performing a heat-softening treatment for the pinch seal area and a glazing treatment for a tubular end of the lead protrusion area, in a state of inserting the electrode assembly from the lead protrusion area and protruding the lead from the lead protrusion area, pinching the pinch seal area heated during a heat-softening treatment and a glazing treatment between molds, thereby simultaneously forming a lead protrusion port while having the lead protrusion area remaining in a sleeve-like shape and a pinch seal portion sealing the pinch seal area, and molding a ridge to a position on a first surface of the pinch seal portion for positioning an external electrode at a predetermined insulation length away from the tubular end of the lead protrusion area, and a chip-off step of chipping-off a top end of the light-emitting area by burner-heating after a completion of pinching of the pinch seal.

4. The method of manufacturing the UV enhancer for the discharge lamp according to claim 3, wherein a thickened portion is formed partially by the molding on the first surface of the pinch seal portion at a position corresponding to the lead and the internal electrode of the electrode assembly sealed in the pinch seal portion.

* * * * *